US005931308A

United States Patent [19]

Gesing et al.

[11] Patent Number: 5,931,308

[45] Date of Patent: Aug. 3, 1999

[54] EDDY CURRENT SEPARATOR AND SEPARATION METHOD HAVING IMPROVED EFFICIENCY

[75] Inventors: Adam J. Gesing, Windsor, Canada; Kevin W. DeHetre, Whitmore Lake, Mich.; Tommy Cranford, Trenton, Mich.; James E. Noe, Woodhaven, Mich.

[73] Assignee: Huron Valley Steel Corporation, Belleville, Mich.

[21] Appl. No.: 08/903,543

[22] Filed: Jul. 30, 1997

[51] Int. Cl.[6] ..... B03C 1/00

[52] U.S. Cl. ..... 209/212; 209/219; 209/636; 209/642

[58] Field of Search ..... 209/212, 213, 209/216, 219, 225, 226, 227, 636, 642

[56] References Cited

U.S. PATENT DOCUMENTS

| | | | |
|---|---|---|---|
| 4,834,870 | 5/1989 | Osterberg et al. | 209/212 X |
| 4,869,811 | 9/1989 | Wolanski et al. | 209/212 |
| 5,080,234 | 1/1992 | Benson | 209/219 X |
| 5,301,810 | 4/1994 | Spencer et al. | 209/45 X |
| 5,494,172 | 2/1996 | Siesco, Jr. | 209/212 |

FOREIGN PATENT DOCUMENTS

| | | | |
|---|---|---|---|
| 0083445 | 12/1982 | European Pat. Off. . | |
| 342330 | 11/1989 | European Pat. Off. | 209/219 |
| 3416504A1 | 7/1985 | Germany . | |

*Primary Examiner*—Tuan N. Nguyen
*Attorney, Agent, or Firm*—Brooks & Kushman P.C.

[57] ABSTRACT

An eddy current separator (10,10*a*,10*b*,10*c*,10*d*, 10*e*,10*f*, 10*g*) and a separation method for separating non-ferromagnetic particles (14) by engaging the particles from above by a distal end (50) of an inclined engagement member (42, 42', 42") to force the particles into a primary magnetic field (34) below a conveyor surface (28) to increase the induced eddy current flow that generates particle magnetic fields such that subsequent release of the particles allows increased magnetic field propulsion to propel the particles distances that vary according to their electrical resistance, densities, shapes and sizes. Different embodiments move the particles into the primary magnetic field by an inclined engagement member (42) that may be a flexible member (42') or a brush (42"), a vertically movable roll (54*a*), a rotary brush (54*b*), an upper auxiliary conveyor (64), an upper belt reach (26) of a belt conveyor (16), a vibratory member (26') of a vibratory conveyor (16'), and an inclined gravity slide (70) that may be a curved trough (72).

8 Claims, 2 Drawing Sheets

EDDY CURRENT SEPARATOR AND SEPARATION METHOD HAVING IMPROVED EFFICIENCY

TECHNICAL FIELD

This invention relates to an eddy current separator and a separation method having improved efficiency for separating non-ferromagnetic particles.

BACKGROUND ART

Eddy current separators have previously been known for separating non-ferromagnetic particles such as disclosed by U.S. Pat. Nos. 4,834,870 Osterberg et al. and 4,869,811 Wolanski et al. Such separators generate a rapidly changing high flux density primary magnetic field through which the non-ferromagnetic particles are conveyed. This changing magnetic flux induces eddy current flow in electrically conductive particles and thereby generates particle magnetic fields repelled by the primary magnetic field. For ferromagnetic particles, the ferromagnetic attraction is stronger than the eddy current repulsion and such particles are thus attracted to the separator. However, non-ferromagnetic particles, after passing through the primary magnetic field, are propelled varying distance depending upon the electrical resistance thereof and consequent electrical flow that divides different levels of particle magnetic fields for the different materials.

Other separators for separating non-ferromagnetic particles are disclosed by German Offenlegungsschrift DE 3416504 Wagner and European patent publication 83445 Steinert Electromagnetbau GmbH. These additional disclosures disclose such separation with falling particles.

Many conventional eddy current separators utilize a rotor having permanent magnets that generate the rapidly changing high flux density primary magnetic field. While new rare earth magnetic materials such as Neodymium-Iron-Boron and new rotor designs permit achievement of higher magnetic fields and higher rates of change of the flux than is possible with prior designs, only a small fraction of the primary magnetic field potential is actually utilized to propel the metallic particles. This is because as the particles enter the primary magnetic field, the repulsive eddy current force lifts the particles and prevents them from entering the stronger portions of the magnetic field. More specifically, conventional eddy current separators have the particles approaching the primary magnetic field generator angularly on the surface of a conveyor belt. The particles are thus conveyed into the primary magnetic field by their momentum and are held down by the force of gravity. Due to the laws of physics, the maximum force that the primary magnetic field can exert on the metallic particles is limited to that required to overcome gravity and change the particle momentum. The net result is that the particles lift off the conveyor belt before reaching the strongest location of the primary magnetic field and hence do not experience the full potential of the primary magnetic force that could be applied to them.

DISCLOSURE OF THE INVENTION

One object of the present invention is to provide an eddy current separator having improved efficiency for separating non-ferromagnetic particles.

In carrying out the above object, the separator for separating non-ferromagnetic particles according to the invention includes a magnetic field generator for generating a rapidly changing high flux density primary magnetic field. A conveyor of the separator conveys the particles along a direction of conveyance above and adjacent the magnetic field generator. The separator includes an inclined engagement member that is located above the conveyor and has an upper mount from which it extends downwardly to a distal end (a) engaging the conveyed particles to force the particles into the primary magnetic field to increase the induced eddy current flow in the particles to generate higher particle magnetic fields repulsed by the primary magnetic field of the generator; and (b) thereafter releasing the particles to allow the repulsion between the particle magnetic fields and the primary magnetic field to propel the particles distances that vary for different metals having different electrical resistances, densities, shapes, and sizes.

The engagement of the particles and forcing thereof into the primary magnetic field induces a greater eddy current flow in the particles to generate larger particle magnetic fields than have previously been possible and consequently a greater propulsion and distance of travel so as to provide better separation between particles of different materials.

In the preferred construction, the separator includes an adjuster for adjusting the position along the direction of conveyance where the particles are released to be propelled by the magnetic fields.

In one construction, the conveyor includes an endless belt and a pair of rotary pulleys that support the endless belt.

The inclined engagement member in one construction has an upper mount that provides pivotal mounting thereof about an axis above the upwardly facing surface of the conveying member. In another construction, the inclined engagement member is made of a flexible material that permits flexing of the distal end thereof during use. This flexible construction of the inclined engagement member is disclosed as including laterally spaced portions that cooperatively define the distal end thereof and that can flex independently of each other. A further construction of the inclined engagement member includes a brush having bristles that define the distal end thereof for engaging the particles.

Another object of the present invention is to provide an improved method for separating non-ferromagnetic particles.

In carrying the immediately preceding object, the method for separating non-ferromagnetic particles according to the invention is performed by generating a rapidly changing high flux density primary magnetic field and conveying the particles on an upwardly facing conveyor surface along a direction of conveyance adjacent the primary magnetic field. The conveyed particles are engaged from above by a distal end of a pivotal engagement member to force the particles into the primary magnetic field to increase the induced eddy current flow in the particles to generate particle magnetic fields repulsed by the primary magnetic field. Thereafter, the conveyed particles are released to allow the repulsion between the particle magnetic fields and the primary magnetic field to propel the particles distances that vary for different metals having different electrical resistances, densities, shapes and sizes.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
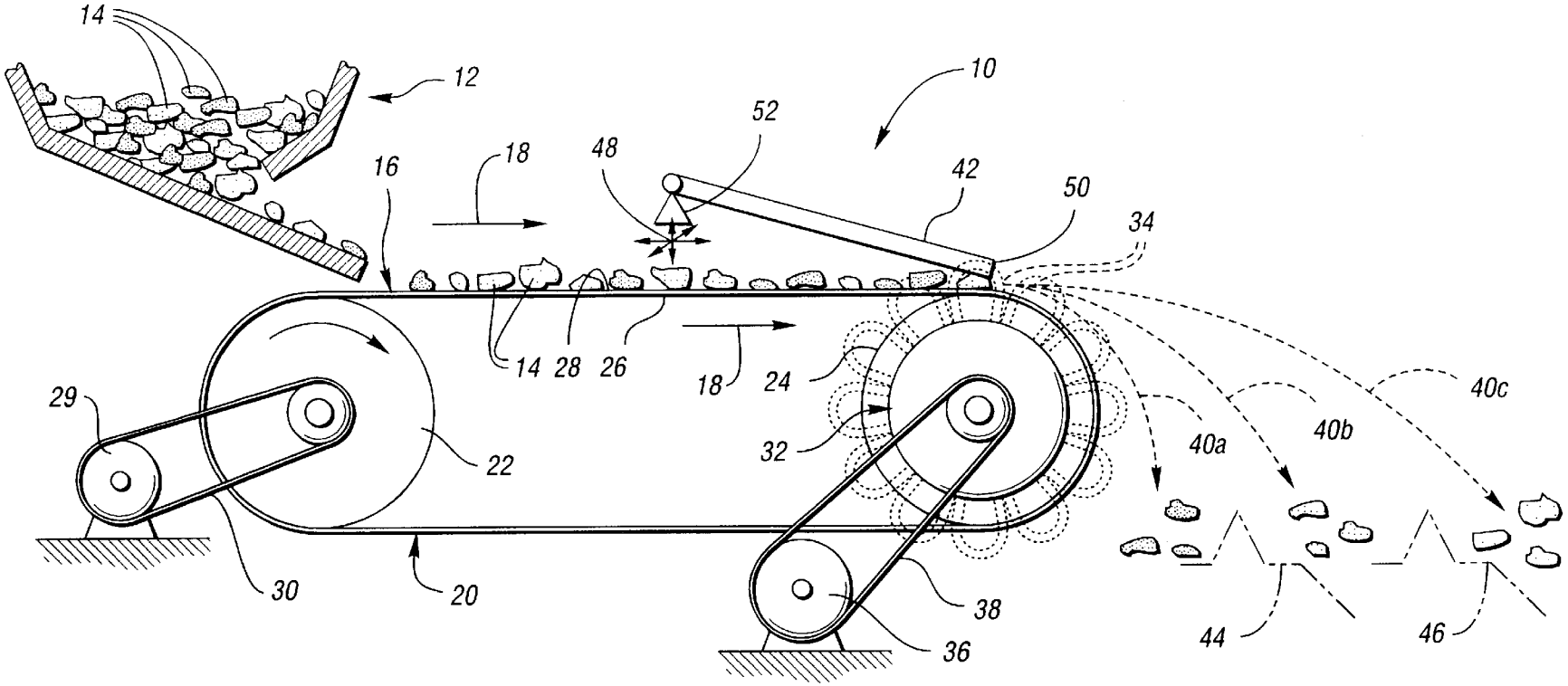
FIG. 1 is an elevational view that illustrates one separator constructed according to the invention to perform the method thereof utilizing an inclined engagement member.
Figure 2:
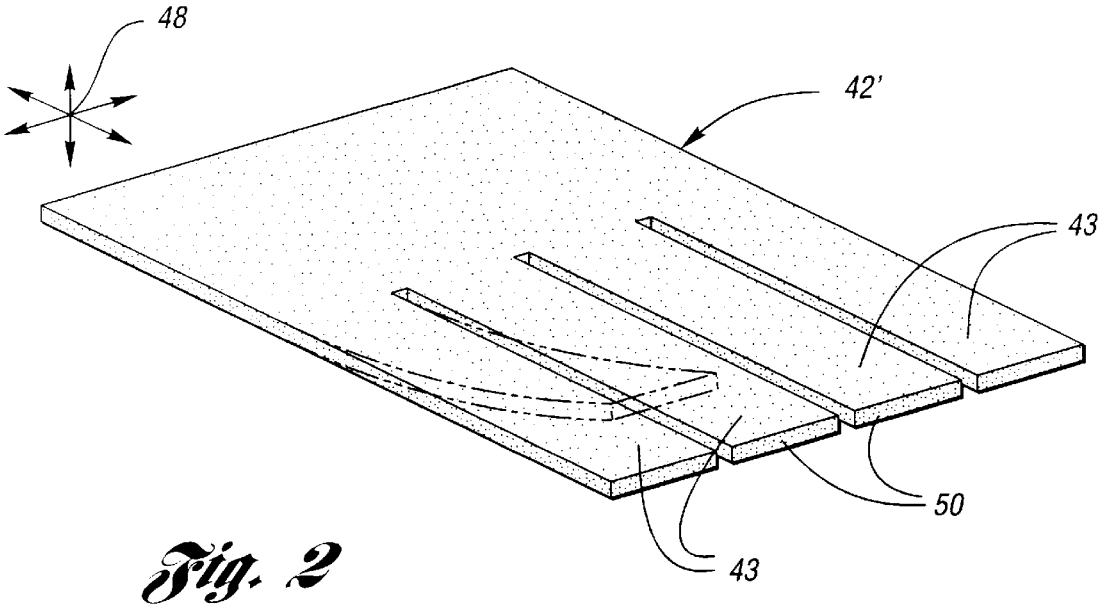
FIG. 2 is a perspective view illustrating another construction of the inclined engagement member which is flexible and has laterally spaced portions.
Figure 3:
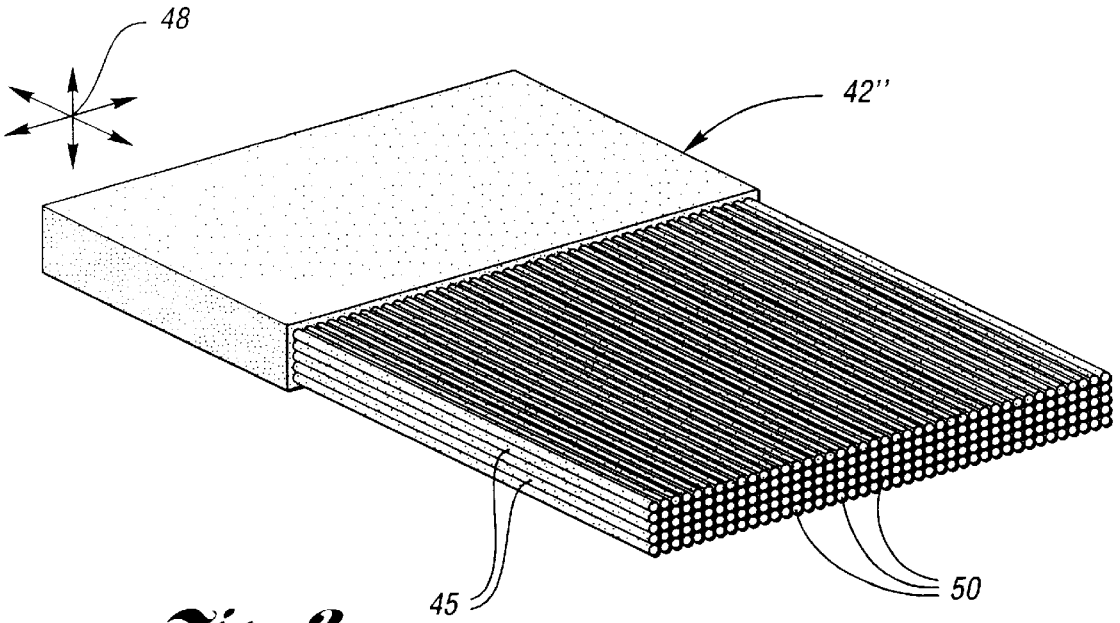
FIG. 3 is a perspective view a further construction of the inclined engagement member which is embodied by a brush having bristles.

With reference to FIGS. 1–3 of the drawings, the separator constructed in accordance with the present invention is identified by 10 as is hereinafter more fully described. The construction of the separator and the method of operation thereof in accordance with the invention will be described in an integrated manner to facilitate an understanding of the different aspects of the invention.

With reference specifically to FIG. 1 of the drawings, the separator 10 illustrated includes a hopper 12 that receives non-ferromagnetic particles 14 to be separated. A conveyor, generally indicated by 16, receives the metallic particles 14 from the hopper 12 for conveyance along a direction of conveyance, as illustrated by arrows 18. The conveyor 16 illustrated is of the type including an endless belt 20 and a pair of pulleys 22 and 24 that support the belt 20 with an upper reach 26 thereof having an upwardly facing surface 28 on which the conveyed particles 14 are supported and moved toward the right. The left pulley 22 is driven by a suitable motor 29 through a drive belt 30. The other pulley 24 is a hollow non-metallic sleeve whose ends are rotatably supported in any suitable manner and that receives a magnetic field generator 32 of the separator. This magnetic field generator 32 generates a rapidly changing high flux density primary magnetic field 34 that is illustrated by the petal-shaped phantom line indicated flux representations. In the specific construction illustrated, the magnetic field generator 32 is shown as a permanent magnet rotor that is rotatably driven by a motor 36 through a drive belt 38. Rapid rotation of the rotor generates the rapidly changing flux patterns that generate eddy current flow of electricity in the non-ferromagnetic particles 14 upon being conveyed adjacent the generator 32 toward the right on the upwardly facing surface 28 of the belt reach 26. Such eddy current flow in the particles 14 generates particle magnetic fields that are repelled by the primary magnetic field of the generator to initiate a force that propels the particles as shown by the trajectories 40*a,* 40*b,* and 40*c.*

With continuing reference to FIG. 1, the separator 10 also includes an inclined engagement member 42 that engages the conveyed particles 14 upon movement toward the right to force the particles into the primary magnetic field 34 against the repulsive force of the initially generated particle magnetic fields as the particles first approach the primary magnetic field from the left. Specifically, the initial generation of the particle magnetic fields can cause the particles to move upwardly off the belt before reaching the right end of the belt and being propelled along one of the trajectories depending upon the extent of the particle magnetic field generated which varies according to the electrical resistance of the material of which the particle is composed, the particle densities, shapes and sizes. However, the engagement member 42 forces the particles deeper into the primary magnetic field 34 so as to create higher flux density particle magnetic fields and a consequent greater propulsion force and a greater separation between the materials so as to provide improved efficiency in the material separation. Specifically, the separating members 44 and 46 provide separation between three different ranges of trajectories of the particles 14. Thus, after the particles 14 have moved sufficiently toward the right so as to be released from the engagement member 42, the conveying momentum and the magnetic field propulsion provides the particle trajectory with a distance that varies according to electrical resistance, density, size, and shape of the particle.

It should be appreciated that whereas the magnetic field generator is illustrated as a permanent magnet rotor as previously mentioned, it is also possible to generate a rapidly changing high flux density magnetic field with stationary coils electrically driven so as to provide flux field rotation in a similar manner to that achieved by the permanent magnet rotor.

With continuing reference to FIG. 1, it will be noted that the inclined engagement member 42 includes a suitable adjuster 48 that is schematically illustrated by arrows and that is movable: (a) to the left and the right to adjust the position along the direction of conveyance where the particles are released for the propulsion as previously described; (b) up and down to adjust the inclination; and (c) laterally with respect to the direction of conveyance.

As previously mentioned, the conveyor 16 shown in FIG. 1 includes the endless belt 20 and the pair of rotary pulleys 22 and 24 that support the belt for the conveying movement. The upper reach 26 of the belt effectively embodies a conveying member having the upwardly facing surface 28 previously mentioned on which the particles 14 are conveyed from the left toward the right as illustrated. The magnetic generator 32 located within the pulley 24 is thus located below the upwardly facing surface 28 of the belt reach 26 embodying the conveying member, and the inclined engagement member 42 that engages and thereafter releases the particles 14 is located above the upwardly facing surface 28.

As shown by continued reference to FIG. 1, the inclined engagement member 42 extends downwardly to the right along the direction of conveyance in a direction toward the upwardly facing surface 28 of the belt reach 26 that embodies the conveying member on which the particles 14 are conveyed. The inclined conveying member 42 has a distal end 50 at which the particles 14 are released for the propulsion thereof by the magnetic fields as previously described. An upper pivotal mount 52 of the inclined engagement member 42 is supported by the adjuster 48 previously described and pivotally mounts the inclined conveying member so that its distal end 50 is moved downwardly under the force of gravity against the upwardly facing conveyor surface 28 of the upper belt reach 26. Adjustment of the adjuster 48 to the left and the right thus adjusts the position of the distal end 50 to adjust the location at which the particles 14 are released. The axis about which the inclined engagement member 42 is pivoted is thus located above the belt reach surface 28 on which the conveyance takes place. It is also possible for the inclined engagement member 42 to have a stop that limits its downward movement so that the distal end 50 does not slide along the upper belt reach 26 of the conveyor belt. Adjuster 48 also has provision for vertical adjustment such that with such a stop, the vertical spacing between the distal end 50 and the upper belt reach 26 can be adjusted.

With reference to FIG. 2, another construction of the inclined engagement member 42' is made of a flexible material that can flex to permit passage of the particles below its distal end 50. More specifically, this construction of the inclined engagement member 42' includes laterally spaced portions 43 that can flex independently of each other across the lateral width of the conveyor when different portions thereof engage particles of different heights.

With reference to FIG. 3, a further embodiment of the inclined engagement member 42" is embodied by a brush having bristles 45 that define its distal end 50 and that flex as the particles pass beneath the brush during the separation operation.

With each of the embodiments of FIGS. 2–3, an upper mount can fixedly mount the associated inclined engagement member 42' or 42" without the need for any pivotal movement in view of the flexing achieved. Nevertheless, a suitable adjuster 48 can be utilized to provide adjustment along the direction of conveyance, up and down, and laterally with respect to the direction of conveyance as required.

While the best modes for carrying out the invention have been described in detail, those familiar with the art to which this invention relates will recognize various alternative ways of practicing the invention as defined by the following claims.

What is claimed is:

1. A separator for separating non-ferromagnetic particles, comprising:

a magnetic field generator for generating a rapidly changing high flux density primary magnetic field;

a conveyor for conveying the particles along a direction of conveyance above and adjacent the magnetic field generator; and an engagement member located above the conveyor, the engagement member having an upper mount and extending downwardly therefrom in an inclined orientation along the direction of conveyance, and the engagement member having a distal end for engaging the conveyed particles to force the particles into the primary magnetic field to increase the induced eddy current flow in the particles to generate particle magnetic fields repulsed by the primary magnetic field of the generator, and the distal end of the engagement member thereafter releasing the particles to allow the repulsion between the particle magnetic fields and the primary magnetic field to propel the particles distances that vary for different metals having different electrical resistances densities, shapes and sizes.

2. A separator as in claim 1 further including an adjuster for adjusting the position along the direction of conveyance where said means releases the particles.

3. A separator as in claim 2 wherein the conveyor includes an endless belt and a pair of rotary pulleys that support the endless belt.

4. A separator as in claim 1 wherein the inclined engagement member has an upper mount that provides pivotal mounting thereof about an axis above the upwardly facing surface of the conveying member.

5. A separator as in claim 1 wherein the inclined engagement member is made of a flexible material that permits flexing of the distal end thereof during use.

6. A separator as in claim 1 wherein the inclined engagement member includes later ally spaced portions that cooperatively define the distal end thereof and that can flex independently of each other.

7. A separator as in claim 1 wherein the inclined engagement member comprises a brush having bristles that define the distal end thereof for engaging the particles.

8. A method for separating non-ferromagnetic particles, comprising:

generating a rapidly changing high flux density primary magnetic field;

conveying the particles along a direction of conveyance above and adjacent the primary magnetic field;

engaging the conveyed particles from above by a distal end of an inclined engagement member to force the particles into the primary magnetic field to increase the induced eddy current flow in the particles to generate particle magnetic fields repulsed by the primary magnetic field; and thereafter releasing the conveyed particles to allow the repulsion between the particle magnetic fields and the primary magnetic field to propel the particles distances that vary for different metals having different electrical resistances, densities, shapes and sizes.

* * * * *

UNITED STATES PATENT AND TRADEMARK OFFICE

CERTIFICATE OF CORRECTION

PATENT NO. : 5,931,308

DATED : August 3, 1999

INVENTOR(S) : Adam J. Gesing; Kevin W. DeHetre; Tommy Cranford & James E. Noe

It is certified that error appears in the above-identified patent and that said Letters Patent is hereby corrected as shown below:

In the Claims

Column 6, line 5, replace "means" with --engagement member--.

Column 6, line 17, replace "later ally" with --laterally--.

Signed and Sealed this
First Day of February, 2000

*Attest:*

Q. TODD DICKINSON

*Attesting Officer*

*Acting Commissioner of Patents and Trademarks*